US006039215A

United States Patent [19]

Bell

[11] Patent Number: 6,039,215

[45] Date of Patent: Mar. 21, 2000

[54] DUAL PRODUCT PUMP DISPENSER WITH MULTI-OUTLET CLOSURE FOR PRODUCT SEPARATION

[75] Inventor: Raymond Charles Bell, West Chester, Ohio

[73] Assignee: The Procter & Gamble Company, Cincinnati, Ohio

[21] Appl. No.: 09/094,538

[22] Filed: Jun. 12, 1998

[51] Int. Cl.[7] ..... B67D 5/52

[52] U.S. Cl. ..... 222/137; 222/145.3; 222/326; 222/563

[58] Field of Search ..... 222/94, 137, 145.3, 222/326, 386, 563

[56] References Cited

U.S. PATENT DOCUMENTS

| | | | |
|---|---|---|---|
| D. 206,993 | 2/1967 | Baker | D4/3 |
| D. 297,305 | 8/1988 | Rudick et al. | D9/300 |
| D. 306,554 | 3/1990 | Lawson | D9/300 |
| D. 313,181 | 12/1990 | Pettengill | D9/403 |
| D. 315,496 | 3/1991 | Pettengill | D9/373 |
| D. 320,735 | 10/1991 | Pettengill | D9/373 |
| D. 373,529 | 9/1996 | Zogg et al. | D9/300 |
| 1,699,532 | 1/1929 | Hopkins . | |
| 2,661,871 | 12/1953 | Huenergardt | 222/129 |
| 2,789,731 | 4/1957 | Marraffino | 222/129 |
| 2,925,938 | 2/1960 | Parsons | 222/94 |
| 2,959,327 | 11/1960 | Bloom | 222/94 |
| 3,105,615 | 10/1963 | Koga | 222/94 |
| 3,166,221 | 1/1965 | Nielsen | 222/137 |
| 3,197,071 | 7/1965 | Kuster | 222/94 |
| 3,236,418 | 2/1966 | Dalle et al. | 222/135 |
| 3,472,423 | 10/1969 | Kaplan | 222/129 |
| 3,493,147 | 2/1970 | Ballin | 222/158 |
| 3,508,682 | 4/1970 | Hollis et al. | 222/48 |
| 3,767,085 | 10/1973 | Cannon et al. | 222/82 |
| 3,814,287 | 6/1974 | Darbon et al. | 222/94 |
| 4,046,288 | 9/1977 | Bergman | 222/135 |
| 4,159,066 | 6/1979 | Silver | 222/129 |
| 4,220,261 | 9/1980 | White | 222/135 |
| 4,261,481 | 4/1981 | Speer | 222/135 |
| 4,392,589 | 7/1983 | Herold | 222/137 |
| 4,461,403 | 7/1984 | Prahs | 222/129 |
| 4,528,180 | 7/1985 | Schaeffer | 424/52 |
| 4,538,920 | 9/1985 | Drake | 366/177 |
| 4,687,663 | 8/1987 | Schaeffer | 424/52 |
| 4,690,306 | 9/1987 | Staheli | 222/80 |
| 4,742,940 | 5/1988 | Wilkinson | 222/162 |
| 4,747,517 | 5/1988 | Hart | 222/137 |
| 4,773,562 | 9/1988 | Gueret | 222/135 |
| 4,838,457 | 6/1989 | Swahl et al. | 222/48 |
| 4,848,598 | 7/1989 | McKinney | 222/391 |
| 4,852,774 | 8/1989 | Crawford | 222/545 |
| 4,961,520 | 10/1990 | White | 222/135 |
| 4,964,539 | 10/1990 | Mueller | 222/94 |
| 4,974,756 | 12/1990 | Pearson et al. | 222/562 |
| 4,979,942 | 12/1990 | Wolf et al. | 604/83 |
| 4,989,758 | 2/1991 | Keller | 222/137 |
| 5,020,694 | 6/1991 | Pettengill | 222/137 |
| 5,038,963 | 8/1991 | Pettengill et al. | 222/145 |
| 5,092,496 | 3/1992 | Gayle et al. | 222/386 |
| 5,169,029 | 12/1992 | Behar et al. | 222/1 |
| 5,224,627 | 7/1993 | Weag | 222/135 |
| 5,271,527 | 12/1993 | Haber et al. | 222/43 |

(List continued on next page.)

FOREIGN PATENT DOCUMENTS

| | | | |
|---|---|---|---|
| 2162821 | 5/1996 | Canada | A61K 7/20 |
| 0 696 450 A1 | 2/1996 | European Pat. Off. | A61K 7/16 |
| 0 703 153 A2 | 3/1996 | European Pat. Off. | B65D 1/04 |
| 0 747 299 A1 | 12/1996 | European Pat. Off. | B65D 81/32 |
| 25 14 201 A1 | 10/1976 | Germany | A61M 5/28 |

*Primary Examiner*—Joseph A. Kaufman
*Attorney, Agent, or Firm*—Vanessa M. Nichols; Leonard W. Lewis

[57] ABSTRACT

The present invention provides a dispensing pump for dispensing a plurality of fluids simultaneously but separately through a spout. The spout has a plurality of discharge orifices and a closure associated with the spout for closing the discharge orifices. The closure is sized and adapted to seal all discharge orifices and further includes at least one plug seal for sealing at least one respective discharge orifice but has fewer plug seals than discharge orifices.

10 Claims, 4 Drawing Sheets

U.S. PATENT DOCUMENTS

| | | | |
|---|---|---|---|
| 5,289,949 | 3/1994 | Gentile | 222/137 |
| 5,295,615 | 3/1994 | Gentile | 222/327 |
| 5,332,124 | 7/1994 | Cancro et al. | 222/137 |
| 5,335,827 | 8/1994 | Gentile | 222/137 |
| 5,464,396 | 11/1995 | Barta et al. | 604/191 |
| 5,482,170 | 1/1996 | Semersky et al. | 215/6 |
| 5,645,193 | 7/1997 | Gentile et al. | 222/137 |
| 5,699,935 | 12/1997 | Stahley | 222/94 |

DUAL PRODUCT PUMP DISPENSER WITH MULTI-OUTLET CLOSURE FOR PRODUCT SEPARATION

FIELD OF THE INVENTION

The present invention relates to co-dispensing fluid pumps and more particularly to such pumps wherein the volume dispensed from each fluid reservoir is a function of reservoir displacement when pistons are pressed against rigid posts within respective cylinders. Even more particularly, the present invention relates to such pumps wherein the rigid posts releasably engage respective piston heads to facilitate disassembly and reassembly of the pump.

BACKGROUND OF THE INVENTION

Dispensing multiple fluid components in accurate proportions has been a long standing need. Such components typically have to be kept apart until the time of dispensing to prevent premature reaction between them. Vacuum type pump dispensers and dual compartment tubes are readily available. However, differences in fluid rheology cause one fluid to flow differently than the other when such dispensers are actuated. As a result, proportions dispensed are often inaccurate. One fluid reservoir may even run out of fluid before the other.

Positive displacement pumps for simultaneous dispensing of multiple fluids in accurate proportions have become available recently. An example is the Mentadent™ toothpaste co-dispenser, a Trademark of Chesebrough-Pond's USA Co. of Greenwich, Conn. The Mentadent co-dispenser has an upper portion containing two cylinders, each filled with different components of a toothpaste. At the end of each cylinder is a piston frictionally engaged in its cylinder to prevent leakage of toothpaste fluid from the cylinder. The upper portion is telescopingly connected to a bottom portion having two upright posts of equal length, which are spaced apart so as to align with the cylinders of the upper portion. When a user presses downward on the upper portion, the pistons are pressed against the two fixed posts. Such pressure causes the pistons to move upward into the cylinders and to drive toothpaste fluids from each cylinder through separate discharge orifices connected to the top of the cylinders. The amount of fluid dispensed from each cylinder is determined by the distance the upper portion is pushed downward and the diameters of the two cylinders. In most cases the cylinders have a common diameter so that the same volume of fluid is dispensed from each cylinder at the same time, regardless of fluid properties. The upper and lower portions of the pump may be disengaged from one another to promote refillability, with the pistons remaining lodged in the cylinders to provide sealed product compartments.

Many commercially-available pump designs, while providing for convenient dual dispensing of two diverse products, require an interlocking geometrical relationship between the posts and piston heads to facilitate alignment during assembly. Others require such interlocking relationships to extract the piston heads from the cylinders when the halves of the pump are disengaged. In addition, the molding of precision fit parts which must engage reliably in the consumer environment is a challenging endeavor when attempting to minimize the material content of the molded parts.

Accordingly, it would be desirable to provide a dual piston, dual dispensing pump which may be readily and economically produced.

It would also be desirable to provide such a pump which provides for reliable engagement of mating parts under in-use conditions of assembly.

SUMMARY OF THE INVENTION

The present invention provides a dispensing pump for dispensing a plurality of fluids simultaneously but separately through a spout. The spout has a plurality of discharge orifices and a closure associated with the spout for closing the discharge orifices. The closure is sized and adapted to seal all discharge orifices and further includes at least one plug seal for sealing at least one respective discharge orifice but has fewer plug seals than discharge orifices.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify like elements and wherein:

DETAILED DESCRIPTION OF THE INVENTION

Figure 1:
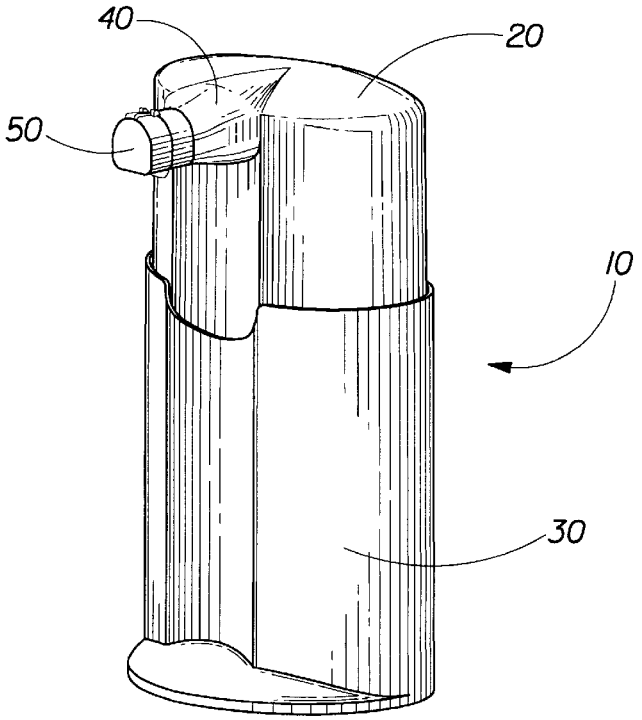
FIG. 1 is a perspective view of a pump dispenser in accordance with the present invention.
Figure 2:
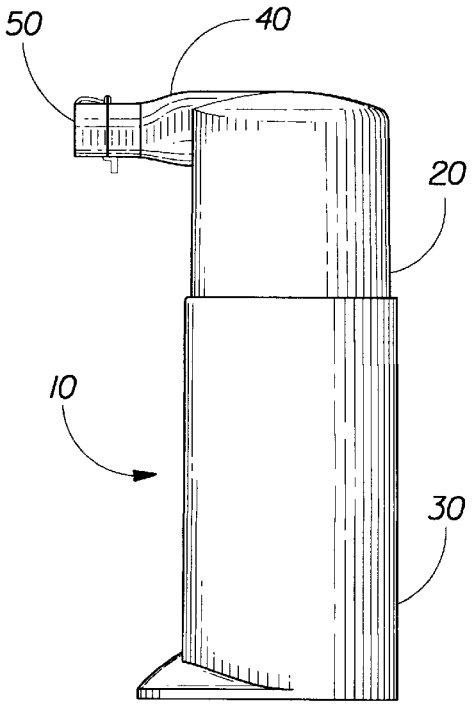
FIG. 2 is a side elevational view of the pump dispenser of FIG. 1.
Figure 3:
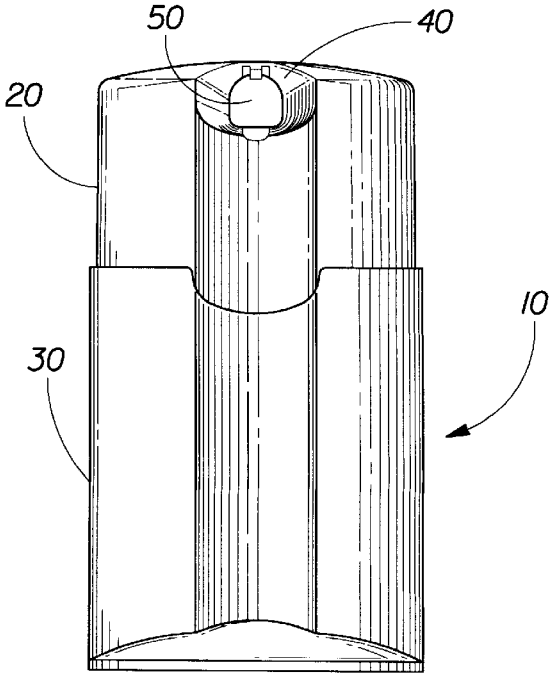
FIG. 3 is a front elevational view of the pump dispenser of FIG. 1.

Referring now to the drawings, FIGS. 1–3 depict a preferred embodiment of the present invention, which provides a co-dispensing pump 10 having an upper portion 20, a lower portion 30, a spout 40, and a cap 50. In the configuration shown in FIGS. 1–3, the upper and lower portions are partially telescoped together sufficiently to retain them in engagement, but before substantial product has been expressed through the spout. Upper and lower portions may contain interlocking snap features (not shown) to form a detent to maintain them in engagement under normal operating conditions, but which may be intentionally overcome by a user to disassemble the pump, as will be discussed hereafter.

In practicing the present invention the term co-dispensing means dispensing multiple fluids, not just two fluids. That is, co-dispensing refers to two or more fluids being dispensed simultaneously from the same dispenser. Accordingly, it should also be understood that while much of the following discussion relates to a presently preferred embodiment of the present invention wherein pairs of elements form a two-fluid dual-dispensing device, the principles of the present invention are equally applicable to other higher-ordered dispensing devices for more than two fluids, such as where "multi" specifically encompasses three-fluid devices, etc.

Figure 4:
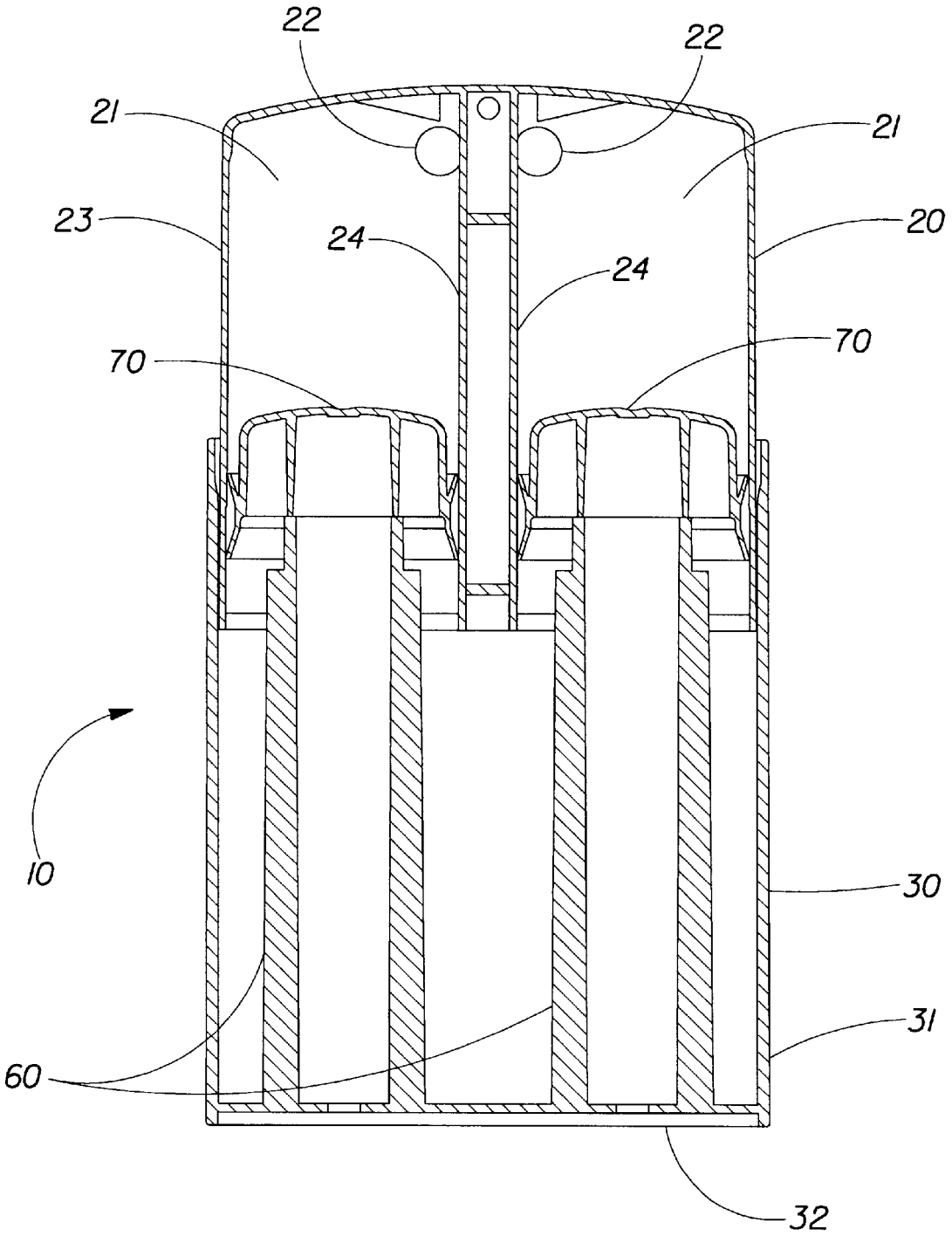
FIG. 4 is an elevational sectional view similar to the frontal view of FIG. 3.

In accordance with the present invention the pump dispenses a plurality of fluids simultaneously but separately through a spout with a predetermined discharge volume ratio for each fluid. FIG. 4 provides an elevational sectional view from the front of the dispenser 10 of FIGS. 1–3. As shown in FIG. 4, the upper portion 20 forms a housing with a plurality of side-by-side annular members 24 depending from it to form cylinders 21 each having a piston 70 slideably disposed therein. Each cylinder 21 also includes a duct 22 leading from the interior of the cylinder to the discharge spout 40 in conventional fashion to direct product from the cylinders for discharge during use. The spout, which may be detachable from upper portion 20 if desired, as well as the ducts are arranged to ensure product segregation until after the fluids exit from the dispenser.

The lower portion 30 includes an outer wall 31 and a bottom 32 which forms the base of the pump dispenser 10, and typically rests upon a countertop or other horizontal surface during use. Such use during the course of dispensing involves telescoping the upper and lower portions together by manually exerting a downward compressive force on the upper portion. The lower portion 30 includes a pair of upright posts 60 located internally of outer wall 31 and cantilevered from bottom 32. The upright posts 60 are preferably substantially rigid and are substantially coaxially aligned with pair of side-by-side annular cylinders 21 of upper portion 20 when the pump dispenser is assembled for use. As with the plurality of annular members and the plurality of pistons, there could be a plurality of upright posts when more than two fluids are to be discharged simultaneously from the same co-dispenser. Preferably bottom portion 30 is unitarily molded.

Figure 5:
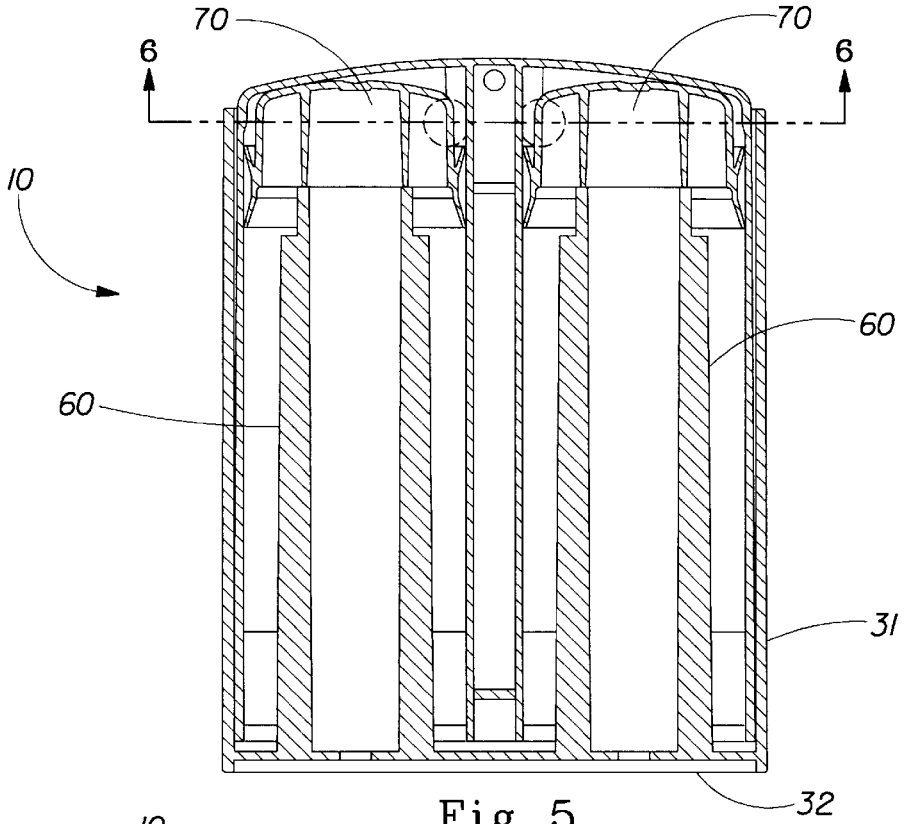
FIG. 5 is an elevational sectional view similar to that of FIG. 4, but with the upper and lower portions fully telescoped together.

FIG. 5 shows upper portion 20 telescopingly engaged with bottom portion 30, in a configuration representative of a substantially-fully-bottomed condition wherein substantially all product from the cylinders would be exhausted. In the embodiment shown, upper portion 20 has outer wall 23 which slides within outer wall 31 of bottom portion 30. However, upper portion 20 could just as easily have had outer wall 23 sliding outside outer wall 31 of bottom portion 30 if a clearance were provided between the exterior of the cylinder walls and the interior of the outer wall 23. In the embodiment shown, however, the cylinder walls are unitarily formed with the outer wall 23. Alternatively, outer wall 23 and outer wall 31 may not be needed if a user carefully aligns posts with their respective annular members, since these members provide their own telescoping engagement with posts. However, the use of such outer walls in a telescoping relationship in addition to the telescoping relationship of the pistons, posts, and cylinders is believed to provide enhanced alignment stability during use.

Figure 6:
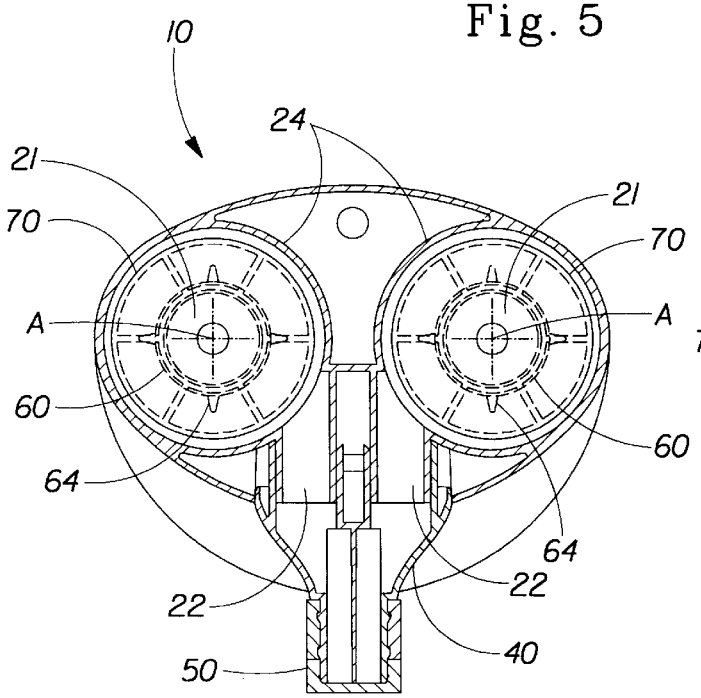
FIG. 6 is a sectional view taken along line 6—6 of FIG. 5.

FIG. 6 is a cross-sectional plan view of the pump of FIG. 5, and depicts in greater detail the relationship of the assembled elements. More particularly, the substantially concentrically aligned relationship of the posts 60, pistons 70, and cylinders 21 is readily visible in this view. Each of these elements share a common central axis "A" which is parallel to the direction of piston travel within the cylinders and to the direction of telescoping of the upper and lower portions during use. In the preferred embodiment shown, all such elements have a circular cross-section in a plane perpendicular to their respective axis "A", such that the central axis "A" thus forms the center of each such circular cross-sections.

Figure 7:
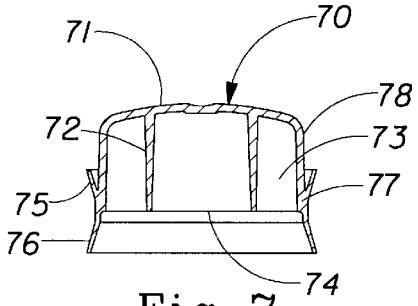
FIG. 7 is an elevational sectional view of a piston.

FIG. 7 provides an elevational sectional view of a piston 70, which includes a domed piston head 71, an outer wall 78, a cylindrical supporting collar 72, a plurality of preferably substantially radially-oriented fins 73 extending between the collar 72 and the outer wall 78, a piston edge 77, and a sealing mechanism comprising upper and lower seal rings 75 and 76 for engaging the cylinder walls 24. The collar 72, outer wall 78, and fins 73 all have a coincident dimension with the piston edge 77 such that the entire lower surface of the piston 70 forms a substantially planar but discontinuous contact surface 74 having spaces 79 between fins 73 (best seen in FIG. 8). The relationship of this substantially planar contact surface to the posts will be described hereafter.

Figure 8:
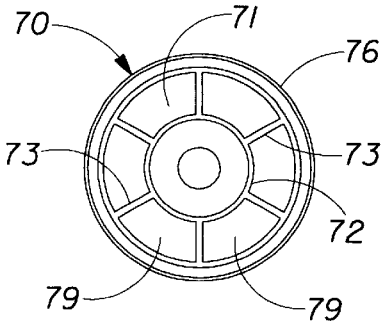
FIG. 8 is a bottom plan view of the piston head of FIG. 7.
Figure 10:
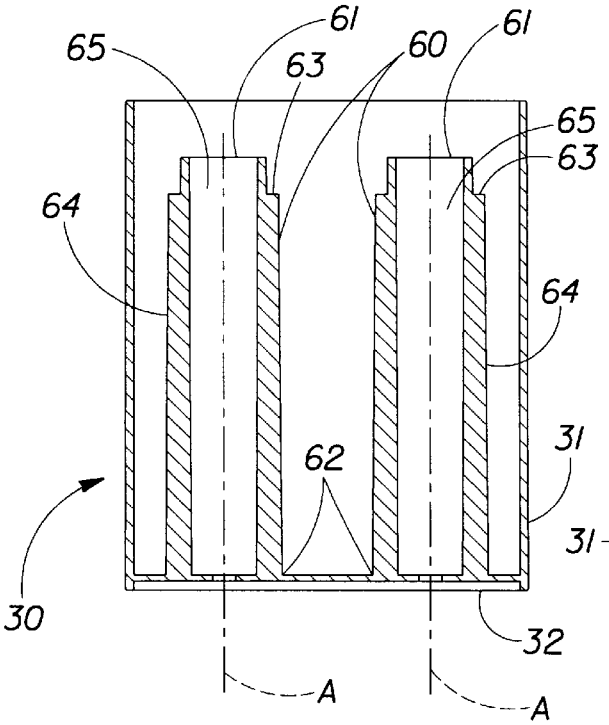
FIG. 10 is an elevational sectional view of the lower portion similar to the view of FIG. 5.
Figure 11:
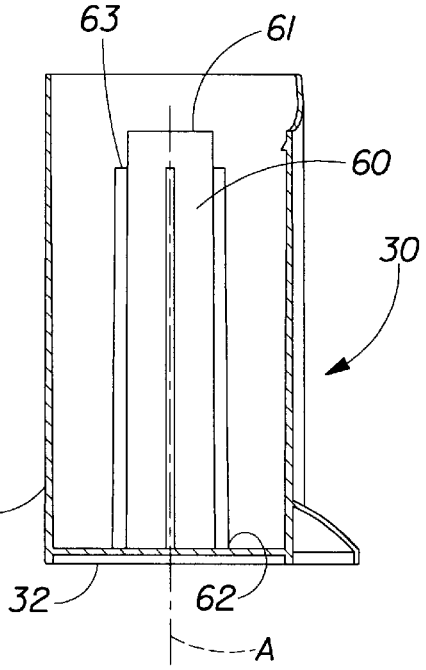
FIG. 11 is a side partially-sectioned elevational view of the lower portion with the outer surface sectioned away to reveal the posts.

FIG. 8 depicts a bottom view of the piston 70 of FIG. 7, and illustrates with greater particularity the substantially radial orientation of the fins 73 extending between the collar 72 and the outer wall 78. The internal structure of the hollow pistons 70 provides a lightweight structure utilizing a comparatively low level of material versus a solid piston head, yet exhibiting significant strength, durability, and dimensional stability in use.

Figure 9:
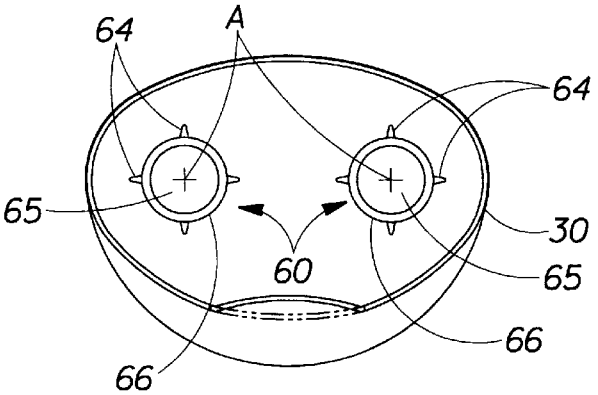
FIG. 9 is a plan view of the lower portion of FIGS. 1–3.

FIG. 9 is a plan view of the lower portion 30, depicting the cross-sectional profile of the posts 60. As shown in FIG. 9, each post is an elongated hollow structure having a hollow interior 65 and an outer wall 66. Extending outwardly from each post 60 is at least one, and preferably a plurality of, reinforcing ribs 64. These reinforcing ribs 64 serve to strengthen the posts 60, particularly when a comparatively thin wall 66 is employed, thereby allowing the molding of comparatively thin but elongated structures which are not only more economical to produce but also more dimensionally stable and less prone to warp or twist. This latter point is particularly important given the substantially coaxially aligned orientation of the pistons, posts, and cylinders required for assembly and operation of the pump.

The reinforcing ribs extend upwardly from the base 32 toward the upper end 61 of the posts 60, but do not extend co-extensively with the length of the post and therefore stop short of reaching the upper end 61 of the post. Said differently, the reinforcing ribs 64 terminate at an upper end 63 which is closer to the base 32 than the upper end 61 of the post 60, such that the ribs each have a length which is shorter than the length of the post they extend outwardly from. This ensures that the uppermost end of the post provides a substantially planar contact surface with a continuous perimeter with no outwardly projecting features for engaging the substantially planar contact surface of the piston 70. This ensures that should misalignment occur when the pistons are brought into engagement with the posts that the upper end of the post does not have projections which would increase the effective diameter of the posts and be more likely to cause premature actuation of the pistons (and premature dispensing of fluid) before alignment and engagement were properly secured. Also, particularly with a hollow reinforced piston structure with a discontinuous lower surface it ensures that there are no projections which could catch structural elements of the piston bottom and possibly cause the pistons to rotate or become misaligned in the cylinder bore.

The reinforcing ribs terminate sufficiently below the end of the post such that under no circumstances do any ribs enter into or engage any elements of the pistons during normal assembly and operation of the pump. This includes any auxiliary elements such as sealing rings or other appendages which may be associated with the pistons.

The posts may have any desired cross-section taken in a plane normal to their central axis, such as circular, square, rectangular, hexagonal, etc., but for ease of production a circular cross-section is presently preferred. The ribs may also have any desired cross-section, such as square, triangular, etc., but the presently preferred cross-sectional shape is a tapered semi-triangular shape as shown with a slightly rounded outer comer. The ribs may be unitarily molded with the posts as is presently preferred, or they may comprise separate elements affixed to the posts. At least one rib, and preferably a plurality of ribs, are provided on each post. For enhanced dimensional stability, the ribs are preferably substantially equally spaced around the periphery of the post, and they preferably terminate substantially concurrently so that they are of approximately equal length. The reinforcing ribs may also have a taper from one end to the other, and as shown in the accompanying drawings the ribs are slightly tapered from being thicker near the base to being thinner near their upper ends for ease of molding. The use of four substantially equally-spaced ribs as shown has proven suitable and constitutes a presently preferred configuration.

In a particularly preferred embodiment of the present invention, upper portion 20 and bottom portion 30 are both injection molded of polypropylene. Spout 12 has a minimal opening of about 44 square mm for each fluid passage.

Figure 12:
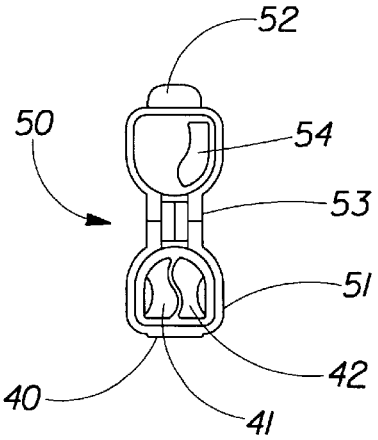
FIG. 12 is a frontal view of the dispensing spout shown in FIGS. 1–3 with the cap in the open position.

FIG. 12 depicts in greater detail another desirable feature of the dispensing pump of the present invention. Cap 50 includes a collar 51, a flip cap 52, and a hinge 53, as well as a plug 54. As shown in FIG. 12, the spout 40 includes a plurality of discharge orifices 41 and 42, each of which have complementary assymetrical shapes. The spout, collar, and flip cap all share a common cross-sectional shape, preferably rounded at its upper portion and substantially planar at its lower portion, such that the collar forms a sleeve which slides over a narrowed section of the spout and may optionally be removable. Although the spout includes two outlet orifices, the flip cap includes only a single plug seal. The plug seal effectively seals one of the two orifices to prevent cross-contamination of the products when the cap is closed, while the outer perimeter of the flip cap engages the spout to form a sufficient seal for all discharge orifices including those without the plug seal. While the presently preferred construction uses two outlet orifices with one plug seal, other multiple outlet configurations could also be accommodated such as three, four, or more outlet orifices with less than all outlet orifices having a plug seal, such as two out of three, one out of three, etc. The ability to form adequate seals without a plug seal is particularly useful when a fluid product having a greater tendency to smear or string is included, such as some gel products.

The dispenser of the present invention is suitable for a wide range of fluid products, particularly wherein it is desired to maintain complete product segregation prior to use. It is presently of interest for dispensing toothpaste compositions in paste or gel form.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A dispensing pump for dispensing a plurality of fluids simultaneously but separately through a spout, said dispensing pump comprising a discharge spout having a plurality of discharge orifices and a closure associated with said spout for closing said discharge orifices, said closure being sized and adapted to seal all discharge orifices and further including at least one plug seal for sealing at least one respective discharge orifice but having fewer plug seals than discharge orifices.

2. The pump of claim 1, wherein said closure comprises a pivoting flip cap.

3. The pump of claim 1, wherein said spout includes two discharge orifices and said closure includes one plug seal.

4. The pump of claim 1, wherein said closure includes a collar for securing said closure to said spout.

5. The pump of claim 1, wherein said closure has an outer perimeter which engages said spout to form a seal for all discharge orifices.

6. The pump of claim 1, wherein said closure includes a collar for securing said closure to said spout and a pivoting flip cap.

7. The pump of claim 6, wherein said collar, said flip cap, and said spout all share a common cross-sectional shape.

8. The pump of claim 7, wherein said cross-sectional shape is rounded at its upper portion and substantially planar at its lower portion.

9. The pump of claim 1, wherein said closure is removable from said spout.

10. The pump of claim 1, wherein said closure engages a narrowed portion of said spout.

* * * * *